United States Patent [19]

Fitzpatrick

[11] Patent Number: 4,683,743

[45] Date of Patent: Aug. 4, 1987

[54] APPARATUS AND METHOD FOR ROLL SIZING DIAMETERS

[75] Inventor: Paul Fitzpatrick, Holland, Mich.

[73] Assignee: Ex-Cell-O Corporation, Troy, Mich.

[21] Appl. No.: 645,977

[22] Filed: Aug. 31, 1984

Related U.S. Application Data

[62] Division of Ser. No. 356,986, Mar. 11, 1982, Pat. No. 4,488,418.

[51] Int. Cl.[4] ..... B21H 5/00

[52] U.S. Cl. ..... 72/88; 72/70

[58] Field of Search ..... 72/88, 90, 70, 469, 72/365, 108; 29/90 R, 90 B

[56] References Cited

U.S. PATENT DOCUMENTS

| | | | |
|---|---|---|---|
| Re. 10,928 | 5/1888 | Simonds | 72/469 |
| 260,196 | 6/1882 | Hastings | 72/108 |
| 319,754 | 6/1885 | Simonds | 72/469 |
| 613,269 | 11/1898 | Hathorn | 72/469 |
| 3,827,269 | 8/1974 | Hoagland et al. | 72/102 |
| 3,890,017 | 6/1975 | Blue | 72/88 |
| 4,208,773 | 6/1980 | Killop | 72/88 |
| 4,383,427 | 5/1983 | Azarevich et al. | 29/90 R |
| 4,408,472 | 10/1983 | Azarevich et al. | 72/71 |

FOREIGN PATENT DOCUMENTS

| | | | |
|---|---|---|---|
| 52-847 | 4/1977 | Japan | 72/88 |
| 479551 | 8/1975 | U.S.S.R. | 72/469 |

*Primary Examiner*—Daniel C. Crane

*Attorney, Agent, or Firm*—Edward J. Timmer

[57] ABSTRACT

An apparatus and method are provided for roll sizing the periphery of cylindrical workpieces to finish and size the workpiece to a close tolerance diameter. The method and apparatus can also be used to prefinish and presize cylindrical workpieces in preparation for subsequent forming of spline teeth or gear teeth and the like on the workpiece periphery.

2 Claims, 16 Drawing Figures

APPARATUS AND METHOD FOR ROLL SIZING DIAMETERS

This application is a division of application Ser. No. 356,986, filed 3-11-82, now U.S. Pat. No. 4,488,418.

BACKGROUND OF THE INVENTION

I. Field of the Invention

This invention relates to cold forming tools and more particularly to tools, apparatus and methods used in the rolling and tooth forming of cylindrical elements.

II. Description of the Prior Art

Finishing of cylindrical metal parts to a desired smoothness or quality of finish can be accomplished by many different types of machining operations and machines, e.g. turning or honing machines, grinders, sanders, EDM and ECM machines. The smoothness obtained is determined by the speed, feed and depth of cut of the particular machine which is performing the task. Generally, a straight turned part is ground after the turning operation if a very smooth finish is desired, i.e. finishes in the 5–25 micro-inch range. Sanding, polishing or buffing machines can also produce similar finishes but these usually lie in the 15 to 25 micro inch range.

The cold working of cylindrically shaped parts to achieve a desired shape or size is old in the art and has been carried out with a variety of machines and methods and the final surface finish of a part rolled or ironed would have some degree of smoothness upon completion of the particular process.

The very early prior art of rolling metals dates back to the late 1800's. Methods for rolling metals, for example, are seen in a patent to Loughrin, No. 625,575, where an apparatus is shown for rolling a square bar into a cylindrical shape. However, the objective of the forming process was to roll the part to a particular form or shape rather than to a particular shape, finish and size. Later processes for rolling spindles and the like are shown in a U.S. Pat. No. 1,504,024 to Clark. The purpose of this particular invention was to straighten spindles, rods, shafts and similar articles. Again, the particular surface finish and size were not the main objectives in that particular patent but burnishing of the surface as part of the process did occur. There are many patents in the field for rolling metals which include the manufacture of rivets, rivet pins, dowels, roller bearings, small cylindrical parts and the like. These are shown in U.S. Pat. Nos. 1,446,447, 2,825,251 and 3,044,332.

The roll sizing process of a surface displaces rather than removes the minute surface irregularities produced with cutting tools and may be applied to both internal and external surfaces. The U.S. Pat. No. 2,480,043 to Paulus et al shows a method for journaling a shaft and bushing which uses tools to iron the bushing onto the shaft. The tight fit of the bushing on the shaft is disrupted by a rolling operation between a pair of opposing die members. The radially applied pressure causes the bushing material to flow and increases its circumferential length on the shaft. Still another more recent U.S. Pat. No. 4,208,773 to Killop shows an apparatus for burnishing gear teeth by use of opposed die racks. Here, the tooth form of the gear is altered by axially crowning the surface of the tooth form by burnishing.

The inventor in the instant patent set out to roll cylindrical components thereby generating plain bearing surfaces and to provide the required pre-roll diameter size on cylindrical components for spline and serration cold forming operations The major problem in rolling teeth on such a surface is that the diameter of the surface to be rolled is extremely critical and must be held to close tolerances. The rolling diameter of the workpiece is selected so that the material volume which is to be displaced from the diameter below the surface will be forced into a tooth form above the initial diameter of the workpiece. Therefore, the initial diameter of the part to be rolled is approximately the pitch diameter of the tooth to be formed. In the normal processes for manufacturing an axle or a shaft which is going to have a spline or gear tooth form rolled on it, the stages of production preceding the rolling of the tooth form are very critical. The piece part is usually first machined on a turning machine, such as a lathe, to a predetermined diameter and then it is ground to hold the diameter within a specific range of tolerances so that when a tooth form is rolled on the shaft, it will have the correct pitch diameter, tooth form, addendum and dedendum.

An object of this invention is to eliminate some of the steps used in the normal production process for the manufacture of the shaft prior to the rolling operation for making the gear tooth form. Another object of the invention is to utilize only a rough finishing operation such as turning on the diameter prior to the rolling operation of the instant invention. Another object of the invention is to displace metal on the surface of the shaft to be rolled in such a way that the final diameter will be within the tolerance range for forming a proper tooth form of the desired pitch diameter.

An object of the invention is to finish shafts to a final finish that preferably does not exceed 25 micro-inches. A further object of the invention is to eliminate the need for a pre-grind or finish-grind of the shaft diameter prior to the tooth rolling operation. An object of the invention is to roll size cylindrical surfaces and reduce the diameter of the surface by cold working the surface to the correct size. Still another object of the invention is to provide a tool which will provide the appropriate finish and desired improvement of the workpiece surface and at the same time reduce the cost of manufacture.

Another object of this invention is to incorporate a roll sizing tool and a tooth forming tool onto the same machine so that the piece part can be pre-sized by the roll sizing tool and subsequently rolled by the tooth forming tool to form the desired spline, serration, thread or gear tooth form. The tools disclosed herein can be used on such machines as shown in U.S. Pat. Nos. 2,995,964 to Drader, 3,818,736 to Blue and 3,982,415 to Killop.

SUMMARY OF THE INVENTION

An object of the invention is to provide a tool for roll sizing the periphery of a cylindrical workpiece surface with the tool including a body having a series of sections associated therewith wherein the first and second sections after the leading edge of the tool will have multiple angled surfaces sloping towards the leading edge and a crown or rake transverse to the direction of travel of the tool to cause metal to be displaced in both radial and axial directions. The second section on the tool in transition with the first section will flatten out or depress the initial crown or edge effect which would be evident in the finished part. A third section of the tool parallel to the tool base will, when used in the machine, effect final compression of the surface and finish the piece part to the desired diameter and surface finish with the final fourth section of the tool allowing relief for the part from between the tools without leaving a tool mark. A combination of the above tool with a tooth forming rack is effective to give low cost tooth form or bearing quality surface finishes.

A method aspect of the invention typically involves cold rolling a rough finished cylindrical workpiece, i.e. an as-turned cylindrical member, between a pair of roll sizing tools that promote initial axial and radial flow of material on the workpiece periphery followed by compressive flow so as to presize the diameter and impart the required surface finish thereto. A tooth forming rolling operation may then be performed on the presized workpiece to provide a toothed power transmission member.

The objects and features of the present tool are readily apparent from the following detailed description of the preferred embodiment given in connection with the accompanying drawings.

DESCRIPTION OF PREFERRED EMBODIMENT

Figure 1:
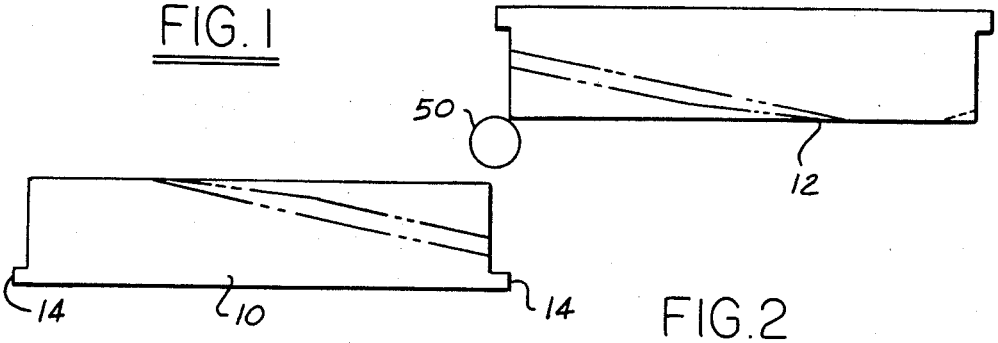
FIG. 1 shows the workpiece and the lower and upper tool in diagramatic form when mounted in a machine.
Figure 2:
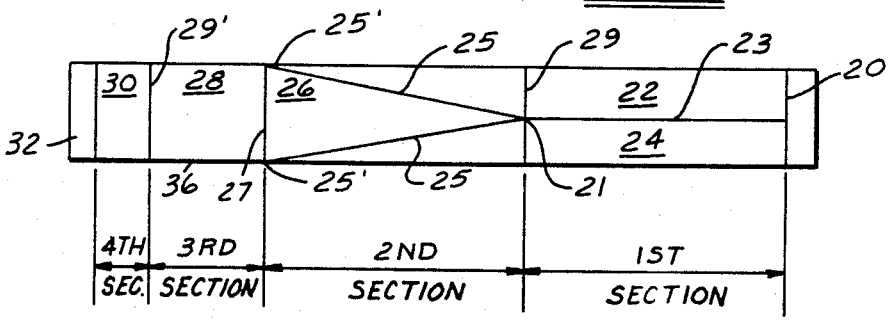
FIG. 2 is a top view of the tool (enlarged) showing the various sections of the tool.
Figure 3:
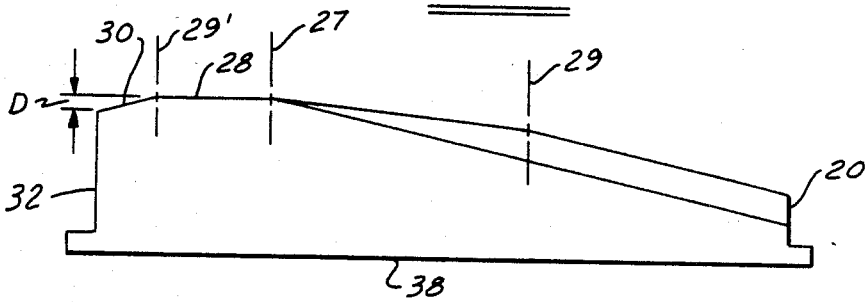
FIG. 3 is a profile or side elevation of the tool shown in FIG. 2.
Figure 4B:
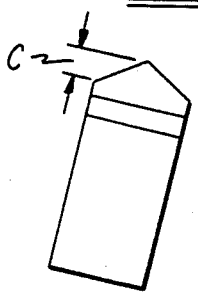
FIGS. 4A and 4B are projections of the tool of FIG. 3.
Figure 10:
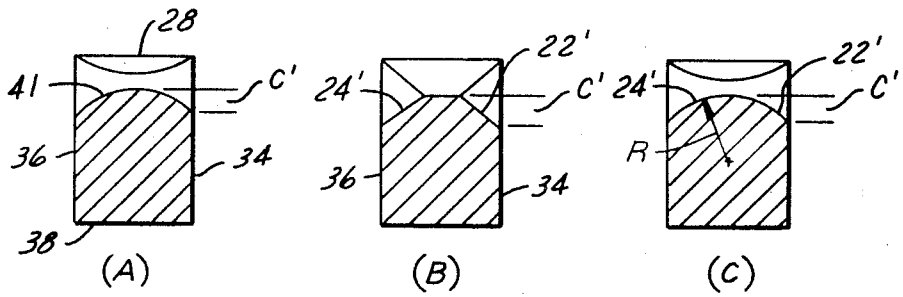
FIG. 10A through 10C are projections in the same plane as FIG. 4B showing other embodiments of the tool working surface.

The apparatus for roll sizing cylindrical surfaces is shown diagramatically in FIG. 1. Tool 10 is the lower roll sizing tool which is mounted to a machine such as shown in U.S. Pat. No. 2,995,964. The upper roll sizing tool 12 is identical to the lower roll sizing tool 10 but is mounted to the upper slide of the aforementioned machine. Piece part 50 is shown in position on the machine and is held between centers for maintaining its location in the machine. The mounting flange 14 is for mounting the tool to the slide members of the machine. FIGS. 2 and 3 are exaggerated views of the tool itself and are not necessarily in actual proportion but are shown here in exaggerated form for purposes of clarity. The tool is shown having a working surface broken up into a number of sections starting with the leading end 20. The first section consists of surfaces 22 and 24 which intersect at an oblique angle to each other along the first section edge 23 extending along the longitudinal midpoint of the tool working surface. In addition, these surfaces slope downwardly toward the leading end 20 and base 38 of the tool. Surfaces 22 and 24 thus have a configuration and dimension providing a crown which promotes gradual flow or movement of metal on the peripheral surface of the part radially and transversely to the direction of travel of the tool (axially on the part). This first section comprises surfaces 22 and 24 ending at the leading end 20 and at sides 34 and 36 and at line 29 through point 21 (for convenience in description). This first section may also be shaped in a rounded crown 41, FIG. 10*a*, or other transversely convex form between the sides, 34, 36 of the tool sloping downwardly toward the sides; i.e. as shown in FIG. 10(*c*) for a combination of a crown having radius R and flats 24' and 22'. FIG. 10(*b*) shows another embodiment having a cross section whereby surfaces 24' and 22' slope downwardly toward sides 36 and 34 from an initial peak at leading end 20 or from a small flat on the top of the first section. Obviously, other crowned shapes can be used for this initial section and still provide the desired results. The crown shape found to provide the best results is that shown in FIGS. 3 and 4B.

The second section consists of surface 26 and the intersection of a continuation of surfaces 22 and 24 from the first section. This second surface 26 is also sloped downwardly toward the leading edge 20 and tool base but is inclined at a smaller angle than the first section. The transition to the third section 28 is noted by edge 27. The second section 26 is thus bound by edges 25, 27 and sides 34 and 36 and line 29 through point 21. Surface 28 is the third section of the tool and is flat and parallel with the base 38 of the tool and its surface finish determines for the most part the ultimate surface finish on the workpiece. Surface 30, which is fairly short in dimension, is the fourth section of the tool and slopes downwardly toward the trailing end 32 of the tool to provide sufficient relief of the part from between the tools without leaving tool marks or otherwise marring the finished roll sized surface. To get some idea of proportion, the first section from leading end 20 to point 21 will make up approximately 37.5% of the total length of the tool. The second section, from point 21 to line 27, will make up approximately another 37.5% of the tool length. The third section 28 will make up approximately 16.5% of the length of the tool. The fourth section 30 will make up approximately 8.5% of the length of the tool. The length noted above for the first section is considered from leading end 20 to point 21. The second section (26) extends from point 21, the intersection of lines 25 and section edge 23, to transition edge 27. The third section is from this edge 27 to edge 29, defining surface 28. The critical surface or section 28, which is the parallel section, preferably will be at least one circumference in length of the part to be rolled. For example, if the diameter to be rolled is one-inch, surface 28 would be from 3 to 4 inches long. If the diameter of piece part is 2 inches, surface 28 would be from 6 to 7 inches long. It is obvious that the length of surface 28 could be only $\frac{1}{2}$ the circumference of the piece part since both the upper and lower tool are working the part as it is rolled.

It was found through experimentation that certain dimensions on the tool gave best results with certain diameters being roll sized. Dimension A shown in FIG. 3 at the beginning of the second section can be from 1 to 3 thousandths (0.001–0.003) of an inch. The dimension B shown in the same figure was selected to be from 5 to 10 thousandths depending on the diameter to be rolled. The incline to give dimension C or the roll off of surfaces 22 and 24, best seen in FIG. 4B, can be varied to provide a C dimension from 2 to 4 thousandths (0.002–0.004) to achieve the best results. Dimension C' in FIGS. 10*a*–10*c* would have similar values. Dimension D shown in FIG. 3 at the trailing end 32 will be approximately 10 thousandths (0.010) for a given tool and does not depend on the diameter.

Figure 5:
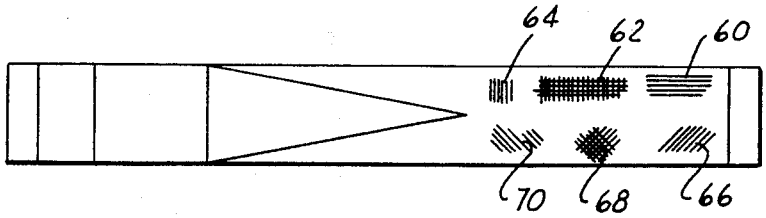
FIG. 5 illustrates the tool having serrations on the tool work surface.

FIG. 5 shows a variation that can be applied to the tools in accordance with the teachings of copending U.S. patent application Ser. No. 356,989, now abandoned, "Apparatus And Method For Roll Sizing Including Presurface Roughening Means" filed in the names of Paul Fitzpatrick and William Rae as joint inventors and of common assignee herewith. This variation involves machining a series of serrations into surfaces 22 and 24. Longitudinal serrations 60 or transverse serrations 64 may be individually applied to the surface or combined to form a cross-hatch pattern 62. A similar pattern at a 45 degree angle to the surface of the tool shows serrations 66 and 70 which also can be applied individually or with a cross-hatch pattern 68 as shown. The purpose of these serrations is to provide the optimum surface finish and surface character on workpieces presented to the roll sizing operation. Specific surface roughness and surface character generated by specific turning tool tip radius, in-feed rate and traverse feed rate in inches per revolution contribute significantly to the ability of the process to induce axial flow of the workpiece material.

Figure 6:
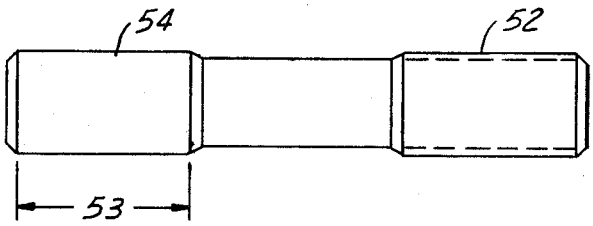
FIG. 6 is a typical part showing surfaces which are worked by the tool.
Figure 7:
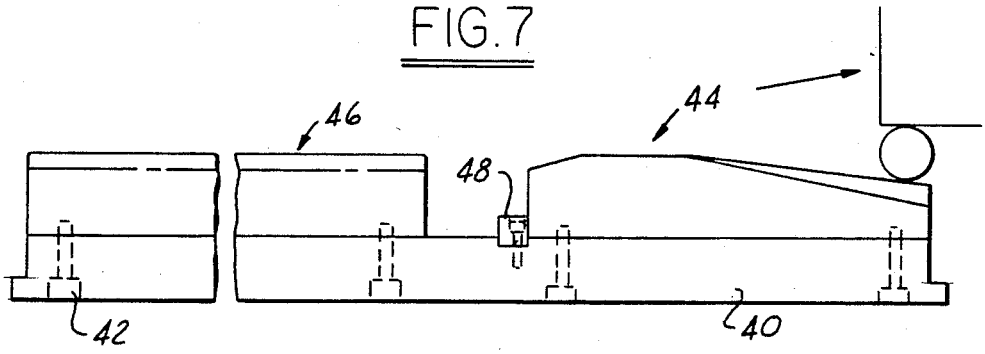
FIG. 7 is an embodiment showing the roll sizing tool in conjunction with a tooth forming tool.

FIG. 6 shows a typical piece part showing spline 52 which was rolled by the apparatus shown in FIG. 7 and diameter 54 which was roll sized to provide required geometry, diameter size and surface finish to function as a plain bearing surface.

In FIG. 7, a pair of roll sizing tools 44 and a pair of tooth-forming tools 46 (only one shown, the other being in line after upper roll sizing tool 44 on the right thereof in the figure) are shown mounted on a base plate 40 by screws 42. Key 48 acts as a stop for the roll sizing tool 44. The piece part 50 is shown in position on the roll sizing tool with the tooth forming tool 46 in line after the roll sizing tool. Such tooth forming tools as are shown in U.S. Pat. No. 3,857,273 to Miller would be appropriate. The tools 44 and 46 in FIG. 7 are shown separated; however, the tools could easily be manufactured in a one piece construction.

OPERATION

With the tool shown in FIG. 3 having dimensions A, B, and C of 3, 10 and 4 thousandths respectively, a number of parts were roll sized to determine the relative diameters and finishes that could be achieved. The dimensions of these parts before and after roll sizing are shown in the following table.

TABLE

| | AS TURNED | | | | AFTER ROLLING | | | |
|---|---|---|---|---|---|---|---|---|
| Part No. | Dia. (inches) | O/R (thous.) | R/O (T.I.R.) (thous.) | Finish (u-inch) | Dia. (inches) | O/R (thous.) | R/O (T.I.R.) (thous.) | Finish (u-inch) |
| R-1 | 1.4155 | .0020 | .0150 | 874 | 1.4083 | .0006 | .0095 | 13 |
| R-2 | 1.4176 | .0009 | .0110 | 771 | 1.4087 | .0013 | .0075 | 13 |
| S-1 | 1.4159 | .0020 | .0140 | 282 | 1.4101 | .0006 | .0075 | 15 |
| S-2 | 1.4144 | .0015 | .0110 | 231 | 1.4092 | .0006 | .0080 | 15 |

Figure 8A:
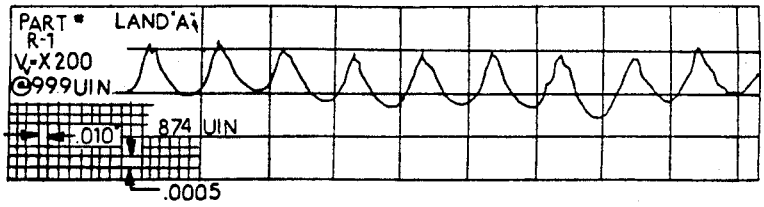
FIG. 8*a* is a reproduction of a strip chart showing the as turned finish on a particular surface of the piece part.
Figure 8B:
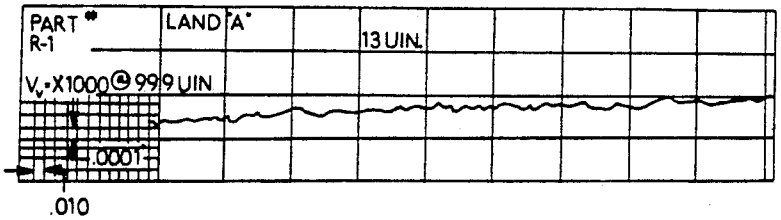
FIG. 8*b* is a reproduction of a strip chart of the same part as in FIG. 8*a* after it has been roll sized.

FIGS. 8(A) and 8(B) show the finish which was achieved for part R-1 before and after rolling. It can be seen that the diameter as turned for this part was 1.4155 inches having an out-of-roundness of approximately 2 thousandths (0.0020), a run-out of approximately 15 thousandths ( 0.0150) and a surface finish of 874 micro-inches. After one pass through the machine having the tool noted above, the diameter was reduced to 1.4083 and the out-of-roundness was reduced to 6 ten-thousandths (0.0006) and the run-out was reduced to 9.5 thousandths (0.0095) with a surface finish of 13 micro-inches. It was observed that the surface finish achieved was the same as the surface finish of the third section (surface 28) of the tool. A second part, R-2, was also rolled and as can be seen from the Table, the surface finish of 771 micro-inches also gave a 13 micro-inch finish after roll sizing. An important result to note is that the original diameter of the parts differed by 21 ten thousandths (0.0021) prior to roll sizing and only differed by 4 ten-thousandths (0.0004) after roll sizing. Other tests were conducted with tools having a working surface wherein surface 26 sloped from line 27 to leading end 20, incorporating both sections 1 and 2 in a single angled plane surface defined by line 27, leading end 20 and sides 34 and 36. In this case, dimensions C shown in FIG. 4B and C' shown in FIGS. 10A through 10C were not ground and surfaces 22 and 24 were nonexistant.

Additional tests were conducted with tools having a working surface wherein the second section sloped from line 27 to line 29 in a single angled plane surface, defined by line 27, line 29 and sides 34 and 36; and first section sloped at a steeper angle than the second section from line 29 to leading end 20 in a single angled plane surface defined by line 29, leading end 20 and sides 34 and 36. In this case, Dimensions C shown in FIG. 4B and C' shown in FIGS. 10A through 10C were not ground and surfaces 22 and 24 were nonexistant.

Figure 4A:
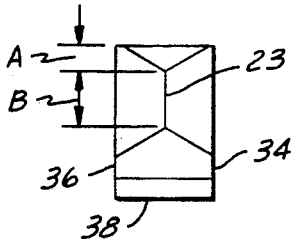

It was found that these parts did not roll size as well and it was concluded from testing that the lateral angle or incline which is noted by Dimension C in FIG. 4 and C' in FIGS. 10A through 10C induces some axial movement of the metal surface in conjunction with the radial or compressive movement induced by inclined surfaces of the first and second sections defined by Dimensions B and A respectively noted in FIG. 3.

The section rolled was diameter 54 having length 53 shown in FIG. 6. Measurable elongation was minimal and was not detrimental to the part in question.

Figure 9A:
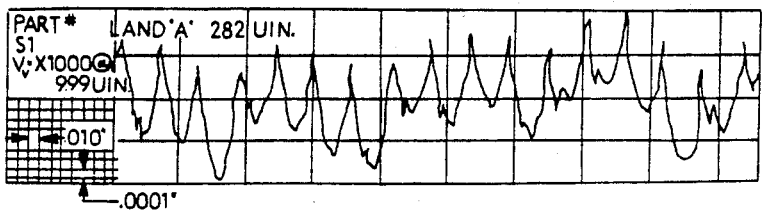
FIG. 9*a* is a reproduction of a strip chart of a cylindrical surface as turned.
Figure 9B:
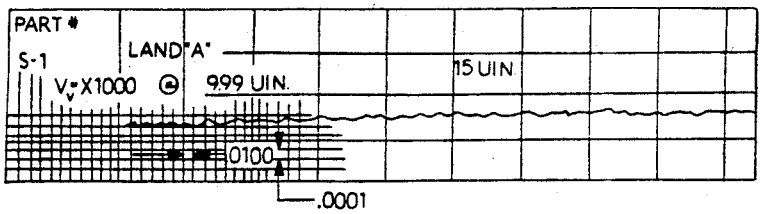
FIG. 9*b* is a reproduction of a strip chart of the same part as shown in FIG. 9*b* after it has been roll sized.

A second part having a smoother initial finish than the first part was also tested. These results are shown in the Table as parts S-1 and S-2 and are shown in FIGS. 9(A) and 9(B). As can be seen in these Figures, the better initial finish of 282 micro-inches, achieved because of a finer feed and smaller tip radius on the turning tool, also gave an excellent final finish i.e. less than 25 micro-inches. If FIG. 8(A) and 9(A) are compared, it should be noted that the vertical scale in FIG. 8(A) is actually five times that, of FIG. 9(A) and although it appears that FIG. 9(A) has a much greater variation, it is actually smoother. This particular part, as can be seen from FIG. 9(B) and the Table, produced a 15 micro-inch finish after the roll sizing operation. Here again, in comparing the two different parts, S-1 and S-2, an initial difference can be seen in the as-turned diameters of approximately 15 ten-thousandths (0.0015) and this was reduced by the roll sizing operation to 9 ten-thousandths (0.0009) difference. The results were completely contrary to what was expected. That is, the inventor believed that a better initial finish would produce a closer tolerance part after roll sizing. However, this was not the case. The unique factor that became quite apparent in subsequent tests was that initial rougher surface finishes, that is, such as those of parts R-1 or R-2, produce closer tolerance diameters after the subsequent roll sizing operation. This unexpected result is believed attributable to the fact that with a rougher surface finish a greater amount of metal can be moved both radially and axially to produce uniformity in diameter. Photo micrographs made of the parts showed the roll sized surface to be cold-worked and actually compressed to eliminate peaks and valleys and give the appropriate finish of less than 25 micro-inches. The results, as seen in the Table are very significant in that the ultimate diameter and tolerance which is needed to achieve a good spline or gear tooth form can be achieved if the original surface has a certain surface roughness such as exceeding 700 micro-inches.

The ultimate result from the experimentation and the final parts that were produced clearly showed that roll sizing of a rough finished surface would produce a consistently closer held final diameter for subsequently rolling of a tooth form for a spline or gear tooth shape. Also a finish grind of diameters prior to rolling splines or gear form can be eliminated from the normal processing steps and thus effect economy in the manufacturing of such gear tooth forms. Further, the ability to size by roll sizing to the very close tolerances needed for these type applications allows the rolling of gear teeth on a part that has only been rough finished by turning on a lathe or screw machine. The closeness of the final diameter and smooth finish of a part after roll sizing has also allowed bearing surfaces on shafts to be manufactured which are normally ground after turning to achieve the desired finish and size. The elimination of such grinding cperations to bearing surfaces on shafts effects a substantial economy of manufacture in time and cost of equipment. Roll sizing does not eliminate the need for burnishing gear teeth if very fine finishes are required. Tooth flank finish is not normally dependent on the surface finish of the preroll diameter. Roll sizing is used primarily to establish a preroll diameter size to present a workpiece with a diameter whose circumference is ideally a multiple of the circular pitch of the form racks.

Figure 11:
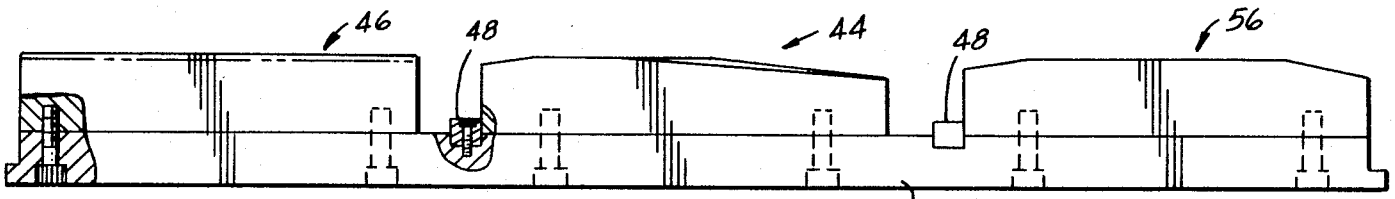
FIG. 11 is a side elevation of an embodiment showing a pre-roll sizing surface preparation tool, a roll sizing tool and a tooth forming toll operatively associated.
Figure 12:
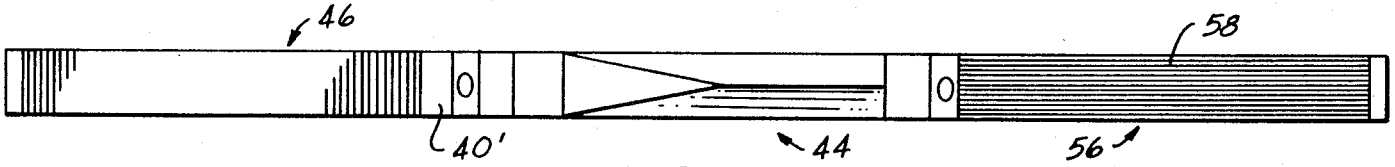
FIG. 12 is a top view of the tool assembly shown in FIG. 11.
Figure 13:
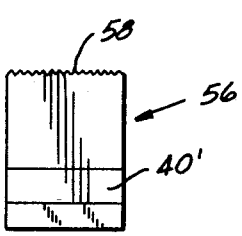
FIG. 13 is a front elevational view of the tool showing the serrations on the surface preparation tool.

FIGS. 11–13 show a roll sizing tool 44, tooth forming tool or rack 46 and pre-working tool 56 described in the aforementioned co-pending application Ser. No. 356,989, now abandoned, mounted to a common base 40' and also having locating keys 48 mounted thereto. Here, the tool 56 has a sloped lead-in section to a flat working section parallel with base 40' with longitudinal serrations 58 to pre-roughen the workpiece surface prior to the roll sizing step using 44. The roll sizing tool 44 imparts the appropriate diameter and surface finish to the workpiece for formation of teeth therein by the tooth forming tool 46.

In summary, this invention provides a method and apparatus for roll sizing the periphery of a cylindrical workpiece wherein the roll sizing tool includes a body having a leading end and a trailing end and is provided with a working surface having a plurality of finishing surfaces thereon. A first section of the tool is disposed between the leading end and the trailing end and is comprised of intersecting surfaces sloping toward the leading edge of the tool and sloping toward each side of the tool; i.e. transversely crowned. A second section of the working surface is disposed between the first section and trailing end of the tool and has a surface sloping at an angle toward the leading edge less than that of the first section. A third section is disposed between the second section and trailing end of the tool and has a single surface substantially parallel to the base of the tool and finally a fourth section is disposed between the third section and trailing edge of the tool having a single surface sloping toward the trailing end of the tool to provide relief for completion of the operation and separation of the workpiece. A second embodiment includes the roll sizing tool and a tooth forming tool mounted in conjunction with each other so that a single pass of the workpiece, the roll sizing tool and the tooth forming racks will provide the desired spline or gear tooth form. It is possible that the rack and part could be cycled in such a way that the piece part is rolled twice through the rack section only to form the tooth shape or to better form the tooth. It was found in operation that a single pass is usually sufficient to achieve the desired results. The process and apparatus of the invention can be used independent of the rack operation to give a finish comparable to that obtained by grinding for use as a bearing surface or in conjunction with the roll sizing tool and forming rack for the manufacture of gear tooth forms.

It is obvious that other changes could be made to the roll sizing tool surfaces, to the mounting of the roll sizing tool and tooth forming rack and to the manufacture of the above tools or portions thereof as a unitary component. It should be noted that the roll sizing tool could be used by itself or with other tools to form or shape the surface of a part capable of being manufactured in a rack type machine. While various forms of the invention have been illustrated and described, it should be understood that the invention is not limited to the exact construction or description and details given but that various alternatives in the tools and their arrangement will be apparent to those skilled in the art without departing from the scope and spirit of the invention.

I claim:

1. A method for finishing a cylindrical workpiece, comprising:

(a) imparting by a turning operation a surface roughness to the workpiece greater than about 700 micro-inches and an oversize diameter, and (b) cold rolling the turned workpiece while it is rotatably supported between and in engagement with a pair of spaced apart facing sliding tools configured to axially move workpiece material on the surface and compress workpiece material on the surface between substantially parallel flat finishing surfaces on the tools each of said finishing surfaces having a surface roughness not exceeding about 25 micro-inches to impart such surface roughness to the workpiece acceptable for bearing surfaces and a reduced diameter acceptable from a tolerance standpoint for subsequent tooth formation thereon, if desired, by said rolling without the need for an intermediate grinding operation on the workpiece after step (a).

2. A method for sizing and pressure forming tooth forms on a cylindrical workpiece, comprising:

(a) machining the workpiece by a turning operation to produce a surface roughness greater than about 700 micro-inches and an oversize workpiece diameter outside the tolerance range for forming tooth forms thereon;

(b) cold rolling the turned workpiece while it is rotatably supported between and in engagement with a pair of spaced apart facing sliding tools which slide in opposite directions against the workpiece as it rotates and which axially move workpiece material on the surface and compress the workpiece material between substantially parallel flat finishing surfaces on the tools having a surface roughness not exceeding about 25 micro-inches to impart that surface roughness to the workpiece acceptable for tooth formation thereon and a reduced workpiece diameter within the tolerance range acceptable for subsequent tooth formation thereon without the need to grind the workpiece after the machining operation of step (a); and (c) rolling the cold rolled workpiece between a pair of toothed facing sliding tools while the workpiece is rotatably supportd therebetween to pressure form tooth forms therein with the desired tooth pitch diameter without the need to grind the workpiece prior to step (c).

* * * * *